US007944194B2

(12) United States Patent
Huang et al.

(10) Patent No.: US 7,944,194 B2
(45) Date of Patent: May 17, 2011

(54) REFERENCE CURRENT GENERATOR CIRCUIT FOR LOW-VOLTAGE APPLICATIONS

(75) Inventors: Ting-Chun Huang, Taipei (TW); Kuan-Yu Chen, Hualien County (TW); Yuan-Hsun Chang, Kaohsiung (TW)

(73) Assignee: Faraday Technology Corp., Science-Based Industrial Park, Hsin-Chu (TW)

( * ) Notice: Subject to any disclaimer, the term of this patent is extended or adjusted under 35 U.S.C. 154(b) by 225 days.

(21) Appl. No.: 12/325,777

(22) Filed: Dec. 1, 2008

(65) Prior Publication Data

US 2010/0052645 A1 Mar. 4, 2010

(30) Foreign Application Priority Data

Sep. 2, 2008 (TW) ..... 97133630 A

(51) Int. Cl.
*G05F 3/16* (2006.01)

(52) U.S. Cl. ..... 323/313; 323/314; 323/315; 323/316

(58) Field of Classification Search ..... 323/265–281, 323/312–316
See application file for complete search history.

(56) References Cited

U.S. PATENT DOCUMENTS

| | | | | |
|---|---|---|---|---|
| 6,359,427 | B1 * | 3/2002 | Edwards et al. | 323/316 |
| 6,373,233 | B2 | 4/2002 | Bakker et al. | |
| 6,522,112 | B1 | 2/2003 | Schmoock et al. | |
| 6,690,147 | B2 | 2/2004 | Bonto | |
| 7,205,827 | B2 * | 4/2007 | Leung et al. | 327/540 |
| 7,218,082 | B2 * | 5/2007 | Walter et al. | 323/273 |
| 2006/0226893 | A1 * | 10/2006 | Abel | 327/543 |
| 2008/0203983 | A1 * | 8/2008 | Lo Lacono et al. | 323/266 |
| 2008/0265853 | A1 * | 10/2008 | Chen et al. | 323/280 |

* cited by examiner

*Primary Examiner* — Adolf Berhane
*Assistant Examiner* — Jeffrey Gblende
(74) *Attorney, Agent, or Firm* — Winston Hsu; Scott Margo

(57) ABSTRACT

A reference current generator circuit suitable for low-voltage applications is provided. The generator circuit is fabricated in a chip for generating a precise reference current based on a precise reference voltage and a precise external resistor. The generator circuit provides an equivalent resistance coupled in parallel with the external resistor to provide resistance compensation and reduce the impedance of seeing into the chip from a chip pad. In addition to the resistance compensation, only moderate capacitance compensation is required to enhance the phase margin of the generator circuit, so as to achieve a stable loop. Therefore, chip area and cost can be reduced in low-voltage applications. In addition, the generator circuit reproduces the reference current generated by the external resistor by utilizing current mirrors, so as to eliminate the effect on currents caused by parallel coupling of the equivalent resistance and the external resistor.

5 Claims, 2 Drawing Sheets

REFERENCE CURRENT GENERATOR CIRCUIT FOR LOW-VOLTAGE APPLICATIONS

CROSS-REFERENCE TO RELATED APPLICATION

This application claims the priority benefit of Taiwan application serial no. 97133630, filed on Sep. 2, 2008. The entirety of the above-mentioned patent application is hereby incorporated by reference herein and made a part of specification.

BACKGROUND OF THE INVENTION

1. Field of the Invention

The present invention relates to a reference current generator circuit for low-voltage applications. More particularly, the present invention relates to a reference current generator circuit applying resistance compensation for increasing phase margins.

2. Description of Related Art

FIG. 1 is a diagram illustrating a conventional reference current generator circuit applying a N-channel metal-oxide-semiconductor field effect transistor (NMOSFET) as a second stage of an operational amplifier. All of components illustrated in the circuit of FIG. 1 are within a chip besides an external resistor R and a ground terminal connected to the external resistor R. A non-inverting input terminal of the operational amplifier OPA receives a precise reference voltage VBG from a bandgap reference circuit, and an inverting input terminal thereof is coupled to a chip pad P. Due to a virtual short circuit of the operational amplifier OPA, a level of the pad P is the same to the reference voltage VBG. Therefore, a precise reference current IR can be generated according to the precise reference voltage VBG and the precise external resistor R.

An external stable capacitor is generally coupled to the chip. Loop stability of the circuit is influenced by the external capacitor and a parasitic capacitor, and capacitance variations of the two capacitors. A NMOS transistor is generally applied to serve as an output stage, and an advantage thereof is that the loop stability is easy to be controlled. Since seeing into the chip from the pad P is a low-impedance point, as long as a metal-oxide-semiconductor (MOS) capacitor C coupling the ground is coupled to an output terminal of the operational amplifier OPA to provide a capacitance compensation, the phase margin then can be effectively controlled. However, when an operation voltage VDD of the reference current generator circuit is excessively low, limited by the structure of the circuit and the fabrication process of the MOSFET, headroom available to the MOSFETs M1 and M2 are insufficient, so that the whole circuit cannot operate normally.

FIG. 2 is a diagram illustrating a conventional reference current generator circuit applying a P-channel metal-oxide-semiconductor field effect transistor (PMOSFET) as a second stage of an operational amplifier. Since the reference current generator circuit of FIG. 2 is lack of one layer of the NMOS transistor, the problem of inadequate headroom is mitigate. However, since gains of two stages are added to the circuit, and the output point thereof has high impedance, if the capacitor coupling the ground is used for phase compensation, a relatively large chip area is required to achieve a good stability.

SUMMARY OF THE INVENTION

Since a conventional reference current generator circuit only applies capacitor compensation in low-voltage applications, a relatively great chip area is required to maintain loop stability thereof. Accordingly, the present invention is directed to a precise reference current generator circuit for low-voltage applications, which can achieve a stable loop via a relatively small circuit area.

The present invention provides a reference current generator circuit for low-voltage applications. The generator circuit includes an operational amplifier within a chip, a capacitor, a compensation circuit and an external resistor disposed outside the chip. The operational amplifier receives a precise reference voltage from a bandgap reference circuit, and transmits the reference voltage to a pad of the chip. One terminal of the capacitor is coupled between a first stage and a second stage of the amplifier, and another terminal of the capacitor is coupled to a ground terminal within the chip for providing a capacitor compensation. The external resistor is coupled between the pad and a ground terminal outside the chip, and is coupled to an operation voltage of such circuit, so as generate a precise reference current in coordination with the precise reference voltage. The compensation circuit is coupled to the pad for providing an equivalent resistance coupled in parallel with the external resistor to provide a resistance compensation and reduce an impedance of seeing into the chip from the pad, and reproduce the reference current generated by the external resistor.

In the aforementioned reference current generator circuit, layers of transistors are relatively less, which avails to reduce an application condition of the operation voltage. The capacitor compensation and the resistor compensation can improve a phase margin of the reference current generator circuit, so as to achieve a stable loop. Due to the resistance compensation provided by the compensation circuit, only a moderate capacitance compensation is required to enhance the phase margin. Therefore, in low-voltage applications, applying of a bulk capacitor is unnecessary, and the chip area and cost of the reference current generator circuit can be reduced.

In an embodiment of the present invention, the compensation circuit includes two current mirrors, and the reference current generator circuit further includes another current mirror. Based on coupling relation of the current mirrors and a current reproducing characteristic of the current mirrors, the compensation circuit can reproduce the reference current generated by the external resistor, so as to eliminate the effect on currents caused by the parallel coupling of the equivalent resistance and the external resistor.

In order to make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
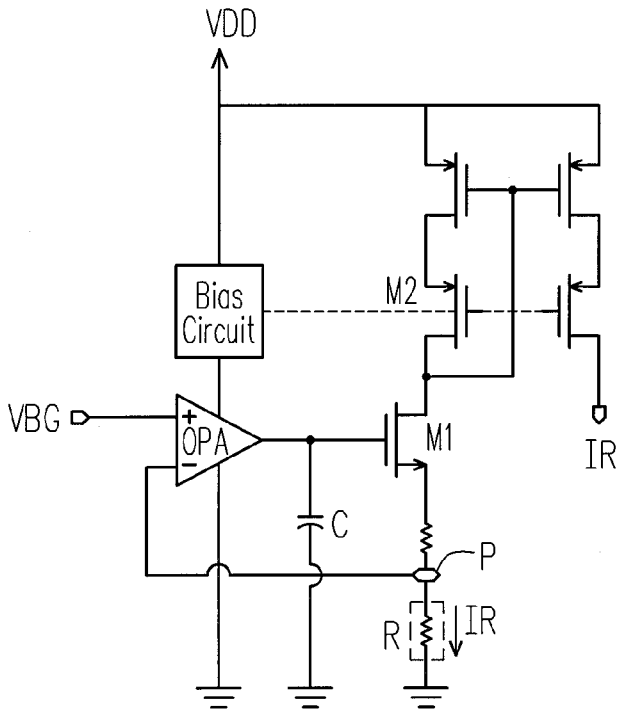
FIG. 1 (PRIOR ART)
FIG. 1 and FIG. 2 are schematic diagrams illustrating conventional reference current generator circuits.
Figure 2:
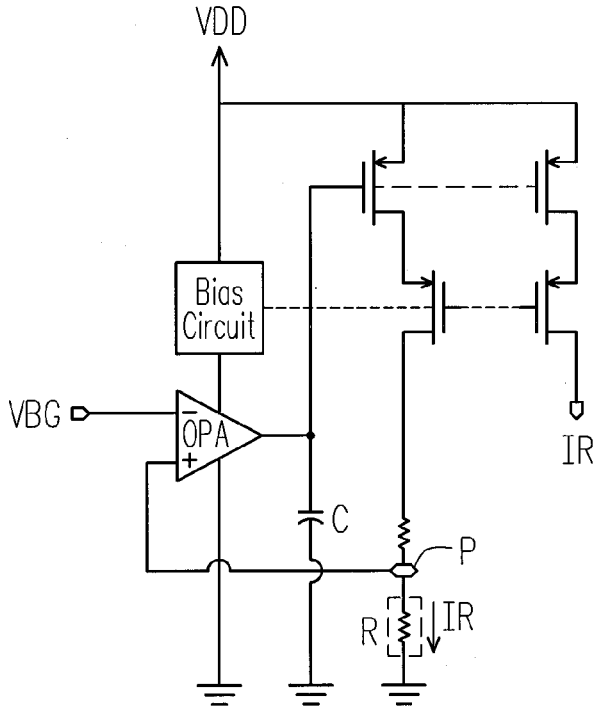
FIG. 2 (PRIOR ART)
Figure 3:
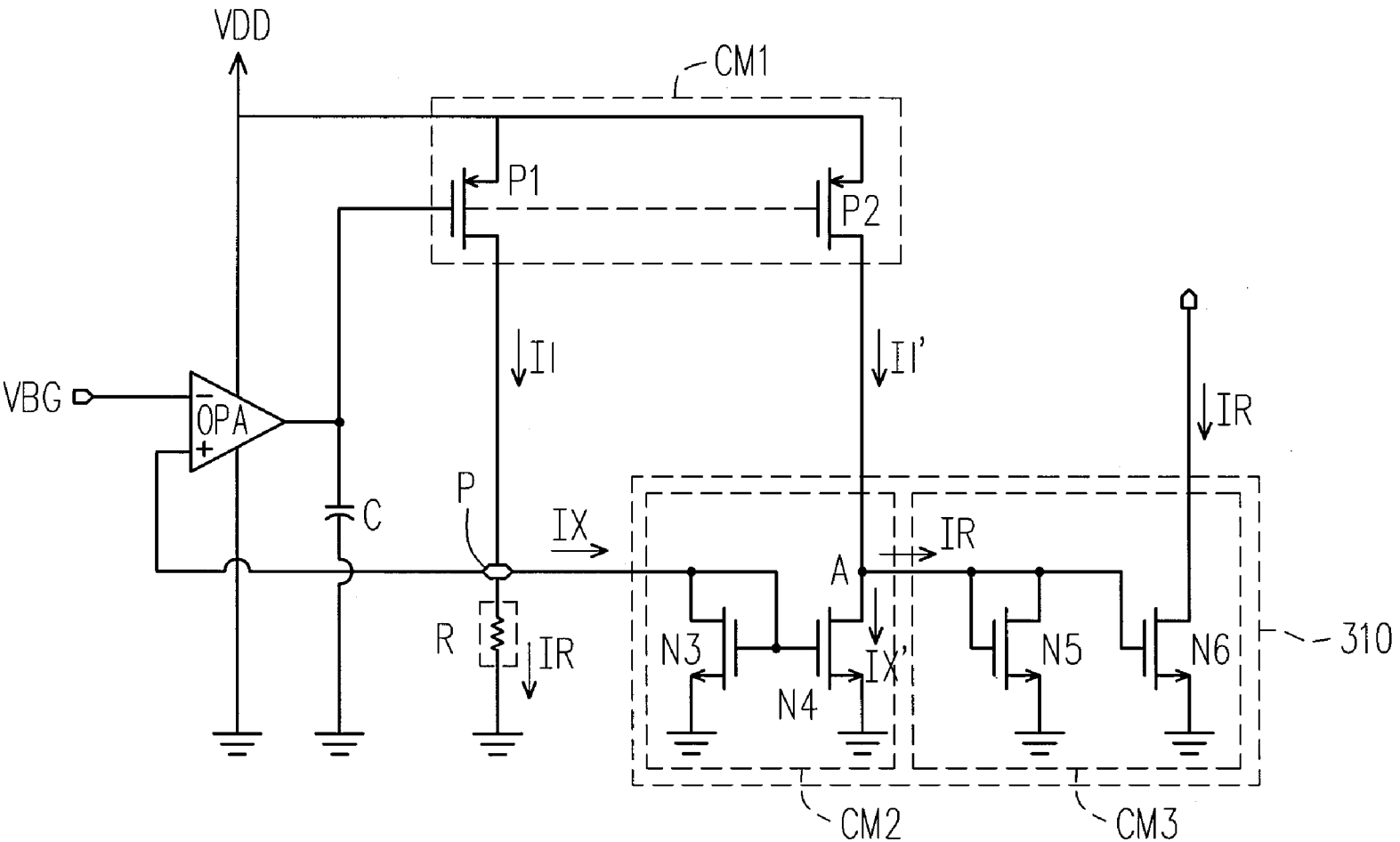
FIG. 3 is a schematic diagram illustrating a reference current generator circuit according to an embodiment of the present invention.

FIG. 3 is a schematic diagram illustrating a reference current generator circuit for low-voltage applications according to an embodiment of the present invention. Referring to FIG. 3, the reference current generator circuit of FIG. 3 includes an operational amplifier OPA, a capacitor C, an external resistor R, a current mirror CM1 and a compensation circuit 310. Wherein, the compensation circuit 310 includes current mirrors CM2 and CM3. Most of components of the reference current generator circuit are disposed within a chip, and the external resistor R and a ground terminal thereof is located outside the chip, and other components of the circuit are all within the chip. The pad P is a circuit connection point for connecting internal and external of the chip.

An inverting input terminal of the operational amplifier OPA receives a reference voltage VBG from a bandgap reference circuit, and a non-inverting input terminal of the operational amplifier OPA is coupled to the chip pad P. A PMOS transistor P1 of the current mirror CM1 is substantially a second stage of the operational amplifier OPA, and only for simplicity's sake, the PMOS transistor P1 is illustrated outside the operational amplifier OPA. One terminal of the capacitor C is coupled to a circuit node between a first stage and the second stage of the operational amplifier OPA, and another terminal thereof is coupled to a ground terminal (referred to as internal ground terminal hereinafter) within the chip for providing capacitance compensation. The external resistor R is coupled between the pad P and a ground terminal (referred to as external ground terminal hereinafter) outside the chip, and is coupled to an operation voltage VDD via the PMOS transistor P1.

The PMOS transistors P1 and P2 respectively form two current paths of the current mirror CM1. The PMOS transistor P1 is coupled between the operation voltage VDD and the pad P for providing currents to the pad P. The PMOS transistor P2 is coupled between the operation voltage VDD and a circuit node A for providing currents to the circuit node A.

NMOS transistors N3 and N4 respectively form two current paths of the current mirror CM2. The NMOS transistor N3 is coupled between the pad P and the internal ground terminal for receiving currents from the pad P. The NMOS transistor N4 is coupled between the circuit node A and the internal ground terminal for receiving currents from the circuit node A.

NMOS transistors N5 and N6 respectively form two current paths of the current mirror CM3. The NMOS transistor N5 is coupled between the circuit node A and the internal ground terminal for receiving currents from the circuit node A. The NMOS transistor N6 is coupled between an output terminal of the whole reference current generator circuit and the internal ground terminal.

A virtual short circuit function of the operational amplifier OPA can transmit the reference voltage VBG to the pad P to serve as a cross-voltage of the external resistor R. A precise reference current IR is generated by dividing the precise reference voltage VBG by the precise resistance of the external resistor R.

Since transistor layers of the reference current generator circuit of FIG. 3 are relatively less, the reference current generator circuit is suitable for low-voltage applications. To achieve a stable loop, the NMOS transistor N3 of the current mirror CM2 is diode-connected for providing an equivalent resistance coupled in parallel with the external resistor R to provide resistance compensation and reduce the impedance of seeing into the chip at a chip pad. The resistance compensation of the NMOS transistor N3 and the capacitance compensation of the capacitor C can improve a phase margin of the reference current generator circuit of FIG. 3, so as to achieve the stable loop. Due to the resistance compensation NMOS transistor N3, the capacitor C is unnecessary to be a bulk capacitor as that of a conventional capacitor, and only a moderate capacitance compensation is required to stabilize the loop. Therefore, the reference current generator circuit of FIG. 3 can be stably operated under the low-voltage environment, and the chip area and cost of the reference current generator circuit can be reduced.

The equivalent resistance of the NMOS transistor N3 coupled in parallel with the external resistor R can influence currents thereof, and the three current mirrors CM1-CM3 are used for resolving a such problem. As shown in FIG. 3, the PMOS transistor P1 provides a current I1 to the pad P, the external resistor R receives a current IR from the pad P, the NMOS transistor N3 receives a current IX from the pad P, the PMOS transistor P2 provides a current I1' to the circuit node A, and the NMOS transistor N4 receives a current IX' from the circuit node A. According to the Kirchhoff's current law, the current I1 is equal to a sum of the currents IR and IX. Similarly, the current I1' is equal to a sum of the current IX' and a current that the NMOS transistor N5 receives from the circuit node A. The current CM1 equalizes the current I1' to the current I1, and the current CM2 equalizes the current IX' to the current IX. Therefore, the current that the NMOS transistor N5 receives from the circuit node A has to be equal to the reference current IR generated by the external resistor R.

The current mirror CM3 also equalizes the current flowed through the NMOS transistor N6 to the reference current IR generated by the external resistor k. The NMOS transistor N6 is coupled to an output terminal of the reference current generator circuit of FIG. 3 for providing the precise reference current IR.

As described above, the compensation circuit 310 is used for providing the resistance compensation and reproducing the reference current IR of the external resistor R. In the present embodiment, the compensation circuit 310 includes the current mirrors CM2 and CM3, though the present invention is not limited thereto, and in the other embodiments of the present invention, the compensation circuits with other designs can also be applied as long as the same function with that of the present embodiment can be achieved.

In summary, the present invention provides a reference current generator circuit which can be stably operated under the low-voltage environment and provide the precise reference current. Due to the resistance compensation applied in the reference current generator circuit, only a moderate capacitance compensation is required, and applying of the conventional bulk capacitor is unnecessary, so as to reduce the chip area and the cost thereof.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A reference current generator circuit, comprising:

an operational amplifier, having an inverting input terminal receiving a reference voltage from a bandgap reference circuit, and a non-inverting input terminal coupled to a pad of a chip;

a capacitor, providing a capacitor compensation, and having a first terminal and a second terminal, wherein the first terminal is coupled between a first stage and a second stage of the operational amplifier, and the second terminal is coupled to an internal ground terminal;

an external resistor, coupled between the pad and an external ground terminal, and coupled to an operation voltage, generating a reference current; and a compensation circuit, coupled to the pad, providing an equivalent resistance coupled in parallel with the external resistor to provide a resistance compensation and reduce an impedance of seeing into the chip from the pad, and reproduce the reference current generated by the external resistor.

2. The reference current generator circuit as claimed in claim 1, wherein the operational amplifier, the capacitor, the compensation circuit and the internal ground terminal are disposed within the chip, and the external resistor and the external ground terminal are disposed outside the chip.

3. The reference current generator circuit as claimed in claim 1, wherein the compensation circuit comprises at least one current minor reproducing the reference current generated by the external resistor.

4. The reference current generator circuit as claimed in claim 1, wherein the compensation circuit comprises a diode-connected transistor providing the equivalent resistance.

5. The reference current generator circuit as claimed in claim 4, further comprising:

a first current minor, coupled among the operation voltage, the pad and a circuit node, providing currents to the pad and the circuit node; and the compensation circuit comprising:

a second current mirror, coupled among the pad, the circuit node and the internal ground terminal, receiving currents from the pad and the circuit node; and a third current mirror, coupled between the circuit node and the internal ground terminal, receiving currents from the circuit node and reproducing the reference current generated by the external resistor, wherein the second current minor comprises the transistor providing the equivalent resistance.

* * * * *